United States Patent [19]

Mathews

[11] Patent Number: 4,738,323

[45] Date of Patent: Apr. 19, 1988

[54] THRUST BEARING AND CONE LOCKING ASSEMBLY FOR ROCK DRILL BIT

[75] Inventor: Will W. Mathews, Germantown, Tenn.

[73] Assignee: Cummins Engine Company, Inc., Columbus, Ind.

[21] Appl. No.: 930,420

[22] Filed: Nov. 14, 1986

[51] Int. Cl.[4] ..... E21B 10/22

[52] U.S. Cl. ..... 175/371; 384/96

[58] Field of Search ..... 175/371; 384/95, 96

[56] References Cited

U.S. PATENT DOCUMENTS

| | | | |
|---|---|---|---|
| 2,787,502 | 4/1957 | Huckshold | 384/96 |
| 4,157,122 | 6/1979 | Morris | 175/371 |
| 4,235,295 | 11/1980 | Zyglewyz | 175/371 |
| 4,266,622 | 5/1981 | Vezirian | 175/371 |
| 4,279,316 | 7/1981 | Helmick | 175/371 |
| 4,533,003 | 8/1985 | Bailey et al. | 384/96 |
| 4,572,306 | 2/1986 | Dorosz | 175/371 |

*Primary Examiner*—Stephen J. Novosad
*Assistant Examiner*—William P. Neuder
*Attorney, Agent, or Firm*—Sixbey, Friedman & Leedom

[57] ABSTRACT

A thrust bearing and cone locking assembly for rotatably mounting the cutter cones on a rock drill bit is provided. The assembly includes a dual function thrust bearing and cone retainer capable of absorbing radial thrust and axial thrust in opposite directions. One end of the thrust bearing is received in a central channel in a journal leg mounted on the bit body and is secured to the journal leg by a circular cross-section snap ring. The other end of the thrust bearing is received in a corresponding confugured receptacle in the cone and is locked to the cone by a dual function rectangular cross-section snap ring which both secures the cone to the thrust bearing and absorbs axial thrust loads. A separate radial thrust bearing is additionally provided between the journal and the cone. A lubricant supply system contained within the assembly provides lubricant directly to all the bearing structures.

23 Claims, 3 Drawing Sheets

THRUST BEARING AND CONE LOCKING ASSEMBLY FOR ROCK DRILL BIT

TECHNICAL FIELD

The present invention relates generally to bits for earth boring drills and particularly to bearing and retention structure for rolling cutter cone-type drill bits.

BACKGROUND ART

Rock drill bits of the rolling cutter cone type are widely employed in such earth boring and drilling operations as the exploration for oil. Many of the earth formations encountered during these operations are quite hard and subject the drill bit to severe stress. Moreover, the drill hole is usually quite narrow in diameter at the bottom in comparison to the diameter of the top, and this configuration subjects the bit to forces from several directions during the course of drilling operations.

The drill bits most suitable for this kind of drilling usually include three cutter cones rotatably mounted on journals attached to a bit body so that the axis of each cone is oriented near the center of the bit, and the teeth located in concentric rings on the face of each cone intermesh with the teeth on adjacent cones to provide the chipping and crushing action required to cut through the earth formation being drilled and create the drill hole. The typical bit body employed to support the cutter cones is rotatably attached to one end of a drill pipe and includes a body portion with three depending leg sections, each of which has bearing and support structure for rotatably mounting a cutter cone which is secured to a journal.

While rolling cone bits have many advantages, a significant disadvantage of this type of drill bit is the inability of the cutter bearing and support structures to withstand the adverse directional forces encountered during drilling operations. In addition, the mounting and support structures themselves must be wear resistant and must hold the cones in the correct orientation. Rock bits are typically subjected to severe impacting and vibration as well as other wear inducing factors that are highly detrimental to the service life of the rotary cutter cone bearings and other bit components. At times, much of the weight of the drill pipe to which the bit body is connected may be caused to act upon the cutter cones, subjecting the cutter cones and their support structure to tremendous mechanical loads.

For example, during reaming operations a cutter cone will be thrust inward toward the center of the drilled hole. At other times, however, the cutter cone will be subjected to stresses that will thrust it away from the center of the hole. If the cutter cone is not held securely in place on its support structure on the bit body it will be thrust off the bit and lost in the drill hole. The loss of only one cutter cone usually is sufficient to render the drill bit essentially useless, and drilling operations must be halted while the bit is brought to the surface, and, if the cutter/cone assembly cannot be repaired or replaced, a new bit is installed. The loss of a cutter cone may not be detected for some time by the drill operator, and the continuation of drilling operations without a full complement of cutter cones could irreparably damage the remaining drill bit components. Moreover, the loss of a cutter cone is potentially extremely costly, since not only must drilling be stopped for an indeterminate time to bring the bit to the surface, but the lost cone, one or more other cones and possibly the entire bit must also be replaced, usually at considerable cost. Consequently, it is of the utmost importance that a rock drill bit be provided with cutter cone bearing and support structure capable of locking the cone in place in the presence of the high forces and other stresses to which rock drill bits are constantly subjected.

Prior art structures designed to support and retain the cutter cones on the bodies of rock drill bits have typically employed a journal bearing pin with bearing elements for rotatably mounting each cutter cone and means for retaining the cutter cone on the journal bearing pin. One commercially acceptable method of cutter cone retention requires the use of balls disposed in axially aligned circumferential grooves formed within the bearing surface of the pin and a corresponding cavity in the cone. This arrangement requires a ball passage extending from exteriorly of the pin to a circumferential groove to permit the loading of the balls after the cone is positioned on the pin. The balls occupy substantial axial space that might otherwise be used for greater journal bearing surface and capacity. Moreover, during normal drilling operations the cutter is forced inward toward the center of the hole so that the balls are directly subjected to loading which may result in the formation of metal debris within the bearing cavity from spalling or partial failure of the ball grooves. Ultimately, the debris may cause failure of the journal bearing and the retention mechanism so that the cutter cone is lost.

Other arrangements for supporting cutter cones which do not employ ball bearings have also been suggested. For example, U.S. Pat. Nos. 4,236,764 to Galle; 4,344,658 to Ledgerwood, III; and 4,491,428 to Burr et al all disclose a frictional cutter cone bearing and retention structure which includes a single substantially circular cross-section snap ring which is received in corresponding retainer grooves having a specifically defined configuration in the bearing pin and the cone to hold the cone on the pin. When the cutter cone is thrust inward, the ring is forced into the retainer groove in the cutter cone to secure it in place on the bearing pin. In arrangements like this which employ a single cutter cone retention snap ring, when the cone is thrust inward, as during reaming, the loading of the snap ring causes stresses that tend to urge the ring deep into the groove, with the possibility of cone loss. Moreover, the bearing capabilities of this kind of arrangement are very limited, and the cone is not securely retained when the cutter cone is subjected to outward thrust.

Retention structure for permanently retaining a cutter cone on a journal pin of a rock drill bit is disclosed in U.S. Pat. No. 4,511,108 to Brunson, wherein a single snap ring having a rectangular cross-section is located in corresponding grooves in the cone and journal pin. The size of the pin groove permits the ends of the ring to overlap and is also larger than the cone groove to prevent out-thrust loading on the ring so that ring is only intermittently subjected to thrust loading. However, despite its apparent advantages, the cone retention arrangement shown in this patent reduces the axial length of the journal bearing surface, thereby minimizing the journal bearing capability. It also requires precise machining of the pin to form a double width portion of the groove precisely where required to allow correct overlap of the snap ring when the cone is installed. Additionally, the pin must be correctly positioned on the bit body or proper insertion of the ring will not be possible, and the cutter cone is likely to respond adversely to thrust loading. Consequently, unless the journal is correctly attached to the bit body with the double width groove in the proper location, the ring may not retain the cone under the types of loads to which the cone is subjected during drilling so that cone loss and its attendant costs are likely.

U.S. Pat. No. 4,157,122 to Morris discloses a friction bearing assembly for a rotary earth boring drill bit wherein the cone cutter is mounted on a separate radial bearing element on the journal spindle. A single, optional retainer element shown to have a rectangular cross-sectional configuration, is also disclosed for use in enhancing cone retention on the bearing in drilling operations where the drill bit will be subjected to heavy loads and excessive vibration not likely to be withstood by the frictional engagement which holds the cone on the bearing. This arrangment, however, relegates to the bearing the dual function of securing the cone and bearing the weight of the cone rotation, which will accelerate bearing wear and, thus cone loss. Moreover, this assembly is not designed to respond to thrust loads on the cutter cone in opposite axial directions. Consequently, failure of the bearing assembly is likely to occur with the resultant loss of a cutter cone during heavy drilling operations or during the drilling of hard rock earth formations.

U.S. Pat. No. 4,444,518 to Schramm et al teaches retention means for a rock bit cone. This arrangement, while effective, employs a complex configuration of segmented arcuate pieces and separate spring elements to overcome the disadvantages of a single snap ring. These elements must be positioned around a circumferential groove in the journal to engage a corresponding groove in the cone and, therefore, are extremely time-consuming to assemble properly and, consequently, costly. Moreover, because significant axial bearing length is consumed by this arrangement, and it is not capable of absorbing axial thrust in both directions, the cone retention structure shown in this patent is not likely to withstand the repeated stresses resulting from most types of drilling operations to avoid cone loss.

The maintenance of the bit bearing structures in a properly lubricated condition is essential to the continued operation of the bit during drilling. Unless adequate lubrication is provided to the journal bearing surface, particularly when frictional bearings are employed, a cone will not be able to rotate freely. This may prevent the rotation of adjacent cones since the teeth will not intermesh properly and is likely to result in the premature termination of the drilling operation. However, none of the aforementioned patents discloses structure which ensures that adequate lubricant will be constantly supplied directly to the cone bearing structures to avoid these adverse consequences.

Therefore, the prior art fails to disclose cutter cone retention and bearing structure for rotary cone-type rock drill bits including separate bearing and retaining elements which provides maximum axial bearing surface and is capable of absorbing axial thrust in both directions and to retain the cutter cone securely in place during repeated, high stress drilling operations, or a cone lubrication supply system which directs lubricant where it is needed most to assure proper lubrication of the cone bearing structure during drilling.

SUMMARY OF THE INVENTION

It is a primary object of the present invention, therefore, to overcome the disadvantages of the prior art.

It is another object of the present invention to provide a bearing and cone retaining assembly for a rock drill bit which substantially minimizes cutter cone loss during drilling operations.

It is a further object of the present invention to provide a dual function rock drill bit cone bearing and locking assembly which provides maximum bearing surface for the cone and absorbs radial thrust loads as well as thrust loads in opposite axial directions.

It is yet a further object of the present invention to provide a rock drill bit cone bearing and locking assembly including an assembly post with dual retaining and locking rings which rotatably locks a cutter cone to the journal of a rock drill bit and maintains the cone on the bit under even the most adverse drilling conditions.

It is a still further object of the present invention to provide radial thrust bearing structure for the cutter cones of a rock drill bit which provides maximum cone bearing surface and is capable of absorbing substantial radial thrust without failure.

It is yet another object of the present invention to provide axial thrust bearing structure for the cutter cones of a rock drill bit which are capable of absorbing all axial thrust loads encountered during drilling operations.

It is yet another object of the present invention to provide a lubrication supply system for the cutter cones of a rock drill bit which conducts lubricant directly to all of the cone bearing structures, thereby insuring an adequate supply of lubricant during drilling operations.

The aforesaid objects are achieved by providing a thrust bearing and cone locking assembly for securing each cutter cone to the bit body of a rock drill bit which has the capability to absorb radial thrust as well as axial thrust in opposite directions. The assembly includes a journal leg specially configured to receive and retain a post and bearing subassembly in a central channel. Each cutter cone to be mounted on the bit includes a correspondingly configured post and bearing subassembly receptacle which receives and retains the post and bearing subassembly. The post and bearing subassembly includes a dual function longitudinal connector pin which provides a secure connection between the journal leg and the cutter cone and serves as a thrust bearing during drilling. The connector pin includes an annular journal retainer groove located toward one end and a circumferential cone retainer stop located toward the opposite end of the pin. The journal retainer groove receives a locking ring which has a substantially circular cross-section and engages a corresponding groove in the journal leg. The cone retainer receives a substantially rectangular cross-section dual function thrust bearing and locking ring which engages an annular ledge in the cone receptacle. A separate radial thrust bearing means is positioned between the journal leg and the cone to extend axially along the journal leg bearing surface when the cone is mounted on the journal leg. The bearing lubricant supply system includes a port in the journal leg central channel whereby lubricant from the bit lubricant supply is directed into the central channel toward the nose of the cone around and through a connector pin and a bearing lubricant supply passage which directs lubricant from the central channel to the journal leg exterior.

Other objects and advantages of the present invention will be apparent form the following description, claims and drawings.

BEST MODE FOR CARRING OUT THE INVENTION

Rolling cutter cone rock drill bits of the type to which the present invention pertains have three major components: the cutters, the bearings which rotatably support the cutters and the bit body. The cutters or cutting elements are typically formed on cone-shaped supports and include circumferential rows of teeth which are positioned to interfit between the rows of teeth on adjacent cones. The bit body includes a leg section for each cutter cone to which is attached a journal which supports the bearings. The bit body further includes a threaded connection for attaching the bit body to the drill stem, lubricant reservoirs and conduits for the flow of drilling fluid. In addition to supporting the cutting elements, the bit body directs drilling fluid supplied to it through the drill stem to the bottom of the hole and to cutters to keep the area being drilled and the cutters clean and to reduce the temperature of the cutters.

During drilling operations a rock bit is subjected to severe stress and substantial adverse forces, particularly if the drilling is being conducted in a hard rock formation. The stresses created on the bit tend to chip, break or loosen the cutting teeth and wear or break the cones. In addition, the bearing surfaces which rotatably support the cones are subject to wear as a result of these adverse forces. Bit manufacturers typically recommend weights and rotary speeds for each type of drill bit which, if followed, will minimize bit wear. If these operation parameters are not followed, however, wear of the bit components will be accelerated. In addition, other factors, such as encountering an unexpectedly hard rock formation, an obstruction in the hole or improperly functioning hydraulics can also accelerate bit wear or even cause bit failure. The configuration of the hole being drilled with its narrow bottom, moreover, can subject the bit cones to large negative axial loads. The cutter cones, in particular, are susceptible to failure since the forces to which they are subjected during drilling thrusts them axially inwardly and outwardly, severly stressing and, in many cases, shearing the cone retention structure. Should this happen, the cone will fall off the bit and be irretrievably lost in the drill hole. The cone retention and bearing structure of the present invention, unlike that of the prior art, is capable of absorbing not only radial thrust, but also axial thrust in both directions so that the problem of the cone loss during drilling as a result of severe negative axial loads is substantially eliminated.

Figure 1:
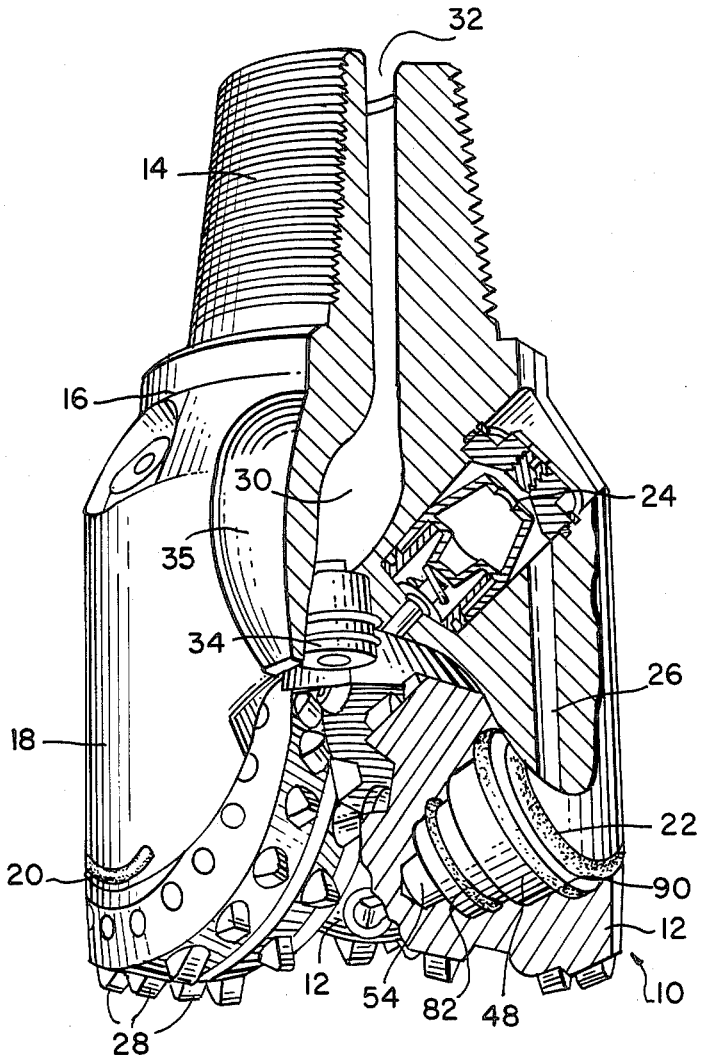
FIG. 1 is a partially cut away perspective view of a rock drill bit showing a cutter cone mounted on a journal leg according to the present invention.

Referring to the drawings, FIG. 1 illustrates, in broken side perspective view, a rock drill bit 10. Although the rock drill bit illustrated and discussed herein has three cones 12, the thrust bearing and cone locking assembly of the present invention may be used with a drill bit having two cones. A threaded drill stem connector 14 is located at the opposite end of the bit from the cones 12. The threaded connector 14 is engaged by a correspondingly threaded drill string or stem (not shown) which extends upwardly from the bottom of the bore hole being drilled by the bit 10 to the earth's surface where it is connected to a drilling rig (not shown).

The threaded connector 14 is part of the bit body 16, which supports three substantially identical leg extensions 18, which, in turn, support the three cones 12. The bit body 16 is caused to rotate about a central axis by the drill stem during drilling operations. Each leg extension 18 includes an outer shirttail portion 20 which may be employed to form the external annular gage surface of the bit. The shirttail portion 20 additionally includes journal mounting structure (not shown) which attaches a journal leg 22 to the bit leg extension. Each cone 12 is rotatably mounted on a journal leg 22, such as is shown in cross-section in FIG. 1 in a manner which will be explained in detail hereinbelow.

A lubrication supply source 24 for providing lubricant to the journal bearing surfaces is contained within the bit body 16 as shown in FIG. 1. A passage 26 formed in each leg extension 18 provides fluid communication between the lubrication supply source 24 and the journal leg to supply lubricant to the journal leg during drilling operations.

Each cone 12, which is rotatably mounted on a journal leg 22, includes cutting teeth 28 which are arranged on the outer surface of each cone in circumferential rows so that the surface of the cone may contain several rows of teeth. The rows of teeth of adjacent cones must be spaced so that optimum intermeshing and interaction of the teeth can occur as the cones rotate on their journal legs during drilling. The pattern and location of the teeth 28 is unique for each type of cone so that these cutting structures will disintegrate the rock formation as the bit is rotated within the hole. The material from which the cutting teeth 28 are formed will directly affect the useful life of the rock drill bit 10. If a single tooth breaks or becomes very worn, the remaining teeth will be overloaded and wear more quickly. Therefore, it is preferred to employ teeth formed either from sintered tungsten carbide alone or tungsten carbide combined with other alloys.

The bit body 16 further includes a central channel 30 coextensive with the axis of rotation and the central longitudinal axis of the drill bit which communicates at one end through a port 32 with the drill stem (not shown) and which may terminate at the opposite end in a plurality of jet nozzles 34, only one of which is shown in FIG. 1. Drilling fluid can then enter the bit body from the drill stem (not shown) through port 32 and pass downwardly through channel 30 to be discharged through nozzle 34. Nozzle housing 35 may be formed integrally with the bit body.

The cessation of drilling operations to replace a lost cutter cone, as previously mentioned, is usually a time consuming, costly procedure. The present invention securely retains the cutter cones on the bit body even under the most severe drilling conditions so that the costly delay which accompanies the loss of a cone is not likely to occur.

Figure 2:
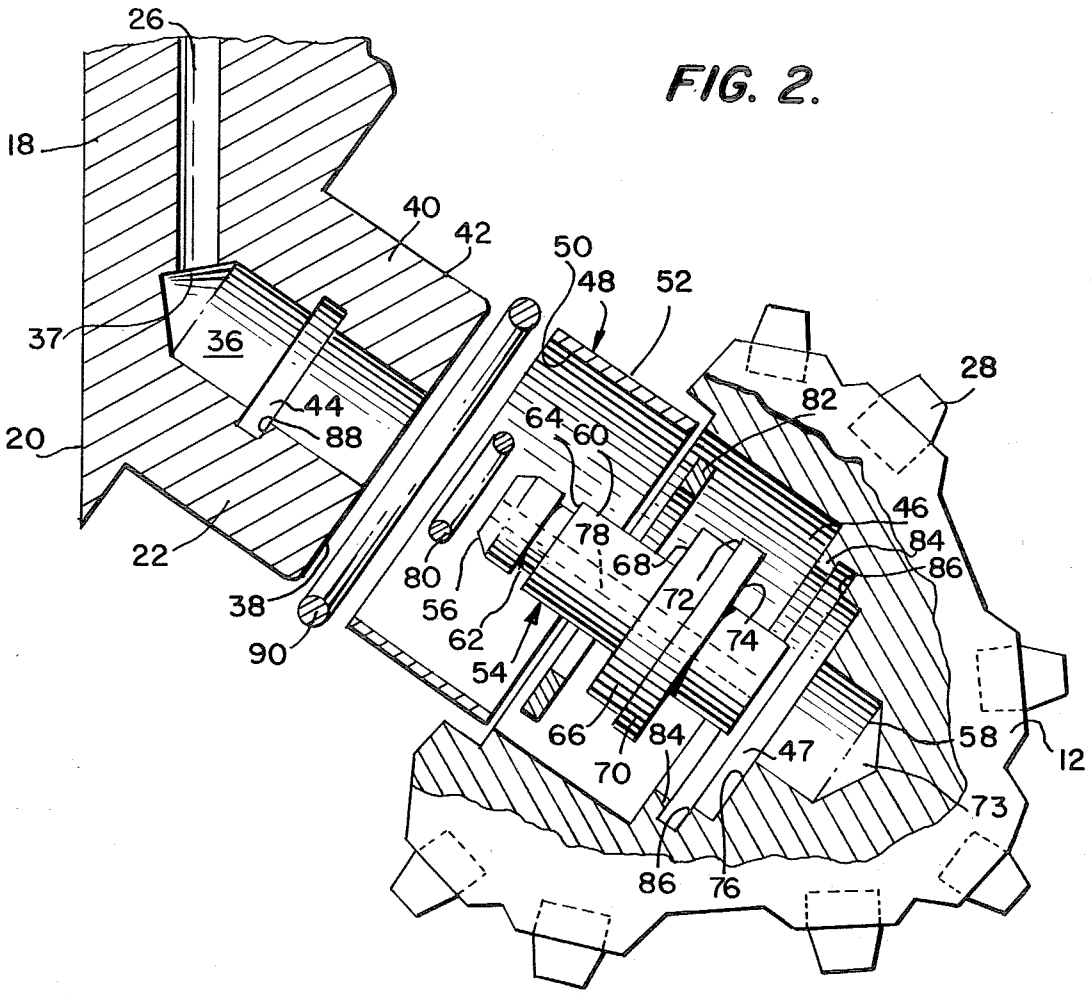
FIG. 2 is an exploded side cross-sectional view of the thrust bearing and cone locking assembly of the present invention wherein the cone has been partially cut away.
Figure 3:
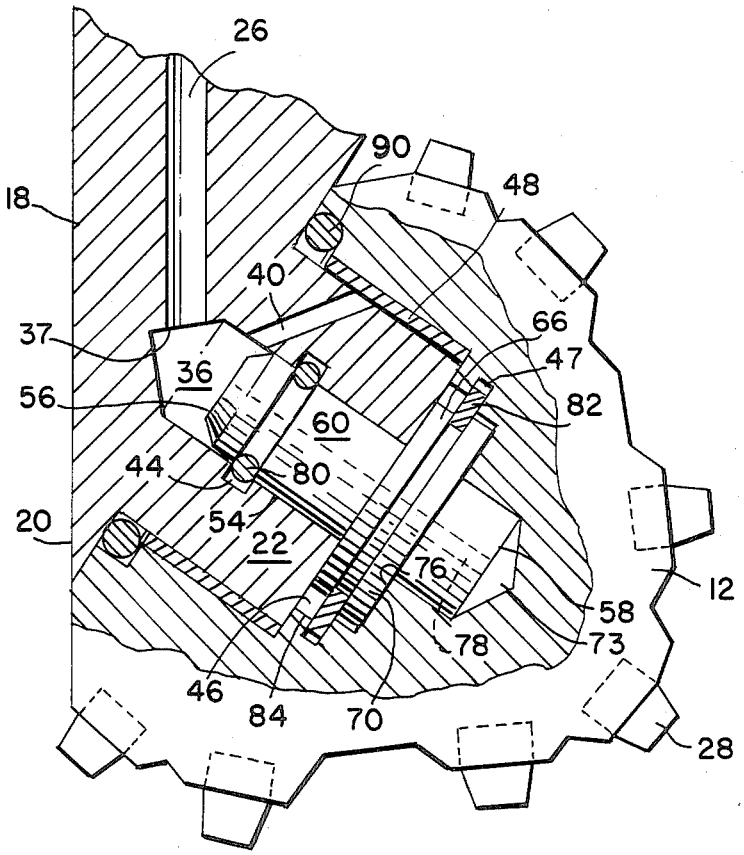
FIG. 3 is a side cross-sectional view of the thrust bearing and cone locking assembly of the present invention mounted in place on a rock drill bit body.

FIGS. 2 and 3 illustrate in detail the cone support, bearing and retention structures of the present invention. In FIG. 2 the cone 12 and journal leg 22 are shown as they would appear in side cross-sectional view prior to the mounting of the cone and the bearing and retention elements on the journal. The journal leg 22 is shown to be formed integrally with the shirttail portion 20 of the bit body leg extension 18, although a separate journal leg section could be formed from the same material as leg extension 18 and attached by a suitable method, such as by an electron beam welding.

Unlike prior art rock drill bit journals or journal pins which may include only a small central passage for lubricant, the journal leg 22 of the present invention includes a large central longitudinal channel or bore 36 which gives the journal leg 22 an annular cross-section. Bore 36 includes a port 37 which communicates with passage 26 and thus provides fluid communication between the bit lubrication passage 26 and the terminal end 38 of the journal leg. A separate lubrication passage 40 is provided to convey lubricant from the bit lubrication supply to the bearing surface 42 of the journal. The journal leg 22 further includes an interior annular groove 44, the function of which will be discussed hereinbelow, positioned around the circumference of and in communication with the central bore 36. While only a single journal leg will be shown and described, the structure of all of the journal legs in the same drill bit will be the same except for the orientations of the journal legs with respect to the center of the bit. The formation of a journal leg having this configuration may be accomplished at a cost which is significantly lower than that of machining the journals of the prior art.

The cone 12 includes an interior journal receptacle 46 which has the stepped configuration shown to securely receive the journal leg 22 and the associated bearing and retaining elements of the present invention. An annular groove 47 is provided in the journal receptacle 46 to receive bearing and retaining structure as will be described hereinbelow. The proper journal receptacle configuration can be machined without difficulty using conventional techniques and equipment.

The bearing structure of the present invention maximizes the bearing surface available to support the cutter cones and, therefore, minimizes adverse reaction of the cutter cones and related structure to stresses resulting from the drilling operation. In contrast to the prior art which uses at least part of the journal bearing surface to support the cone retention structure, the present invention allows substantially all of the axial length of the journal bearing surface 42 to be utilized for cutter cone support. A radial thrust bearing 48 is provided which includes a journal contact surface 50 which contacts the bearing surface 42 of the journal 22 and a cone bearing surface 52 which supports the cone 12 when the cone is positioned in place on the journal as shown in FIG. 3. Bearing 48 may be formed from any conventional material known to provide good bearing capability, such as one of the non-ferrous alloys available for this purpose. The interior diameter of bearing 48 should be slightly larger than the exterior diameter of the journal 22 to allow the rotation of the bearing about the journal.

Figure 4:
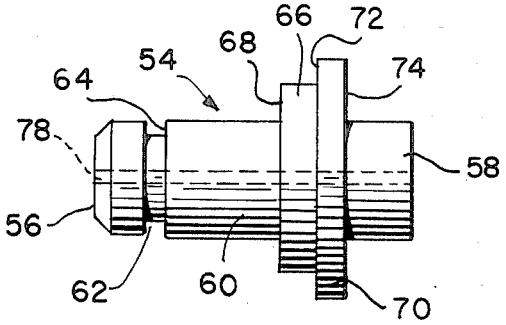
FIG. 4 is a side view of the dual function connector pin and thrust bearing of the present invention.

The cone retention structure of the present invention is entirely internally contained within the central bore 36 of the journal leg 22, thus leaving substantially all of the bearing surface 42 on the exterior of the journal leg available for bearing purposes. The confinement of the cone retention structure to the interior of the journal is achieved by providing a connector pin 54 which functions as a combined assembly post and thrust bearing when the cone 12 is mounted on the journal leg 22. The specific configuration of pin 54 which enables it to perform this dual function is shown in FIG. 4.

The pin 54 includes a journal engaging end 56 and a cone engaging end 58. The pin 54 further includes a central body section 60 which extends between the journal engaging end 56 and the cone engaging end 58. The journal engaging end is preferably chamfered as shown and is provided with a circumferential ring groove 62 which separates the end 56 from the body section 60 and is located to correspond to annular groove 44 in central bore 36 when the pin 54 is positioned in its correct location within bore 36.

The pin central body section 60 has a slightly larger diameter than the pin end 56 to form a lip 64 which holds a retaining ring in place when the assembly is mounted in place as described below. The diameter of pin central body section 60 corresponds approximately to the diameter of central bore 36 so that a tight press fit is achieved when the pin 54 is inserted into the journal leg central bore 36.

The pin central body section 60 further includes a circumferential stop 66 having a lower surface 68 which engages surface 38 on the terminal end of the journal leg 22. The distance between the pin ring groove 62 and surface 68 of the pin stop 66 corresponds to the distance between the journal leg annular groove 44 and the journal leg exterior surface 38. This results in the alignment of journal leg groove 44 and pin groove 62 when the pin is positioned within the journal leg central bore. A shoulder 70, having a larger diameter than stop 66, is located on the pin 54 between the stop 66 and the cone engaging end 58. The shoulder 70 includes a retention surface 72, which functions to retain the cone on the pin 54 and, hence, on the journal leg as will be described below, and a cone engaging surface 74 which fits against a corresponding cone stop 76.

The pin 54 is also preferably provided with a central channel 78 to convey lubricant from that supplied to central bore 36 through passage 26 directly to the nose 73 of the cone receptacle 46 and the bearing structures located therein.

The cone receptacle 46 has the stepped configuration shown to accommodate the largest possible axial extent of the journal leg 22 and to engage and limit the axial movement of the pin 54 within the receptacle. The receptacle configuration and, in particular, cone shoulder 76 is structured to receive and hold cone retention elements designed both to prevent the removal of the cone from the journal during drilling and to absorb axial and radial thrust loads.

The cone bearing and retention assembly includes, in addition to connector pin 54, retaining and bearing elements consisting of a pin retainer 80 and a cone retainer and bearing 82. Both retainers are preferably in the form of circular, split snap rings. As shown in FIGS. 2 and 3, the pin retainer 80 has a substantially circular cross-section, while the cone retainer and bearing 82 has a substantially rectangular cross-section.

The interior and exterior diameters of the pin retainer 80 are selected so that the retainer may be compressed to a diameter which is approximately that of journal central bore 36, but will expand to be slightly greater than the diameter of the pin body section 60. The interior diameter of retainer 80, however, should be at least equal to or slightly greater than the diameter of pin 54 in the area of groove 62 or the retainer 80 will not be able to be compressed sufficiently to fit within journal leg central bore 36. The dimensions of the cone retainer and bearing 82 are limited primarily by the diameter of pin shoulder 70, the diameter of pin stop 66, and the diameter of cone annular groove 47. Additionally, the exterior diameter of retainer and bearing 82 must not exceed the interior diameter of the cone receptacle 46 at annular ledge 84 or the retainer and bearing 82 will not be able to be compressed to a size which will allow it to pass the cone receptacle ledge 84.

Although the connector pin 54 will remain in place within the journal leg central bore 36 without the retainer 80 because the press fit achieved is sufficient to retain the pin, superior retention and locking of the pin 54 are achieved by the addition of the retainer 80.

The specific configurations of both the pin 54 and the cone retainer and bearing 82 have been selected to impart a bearing function to these elements which ultimately allows the cone to be subjected to radial thrust and axial thrust in both directions without adverse results. The rectangular cross section of the cone retainer and bearing 82, for example, will bear the bidirectional axial thrust associated with the negative axial load exerted on the heel of the cone at the bottom of a narrow drill hole. The connector pin 54 will also absorb axial thrust in both directions and will absorb radial thrust loads in addition. The preferred material for forming these structures is a beryllium copper alloy which is characterized by high strength and bearing capability. However, any strong non-ferrous alloy having a crystalline structure which is dissimilar to the crystalline structure of the material from which the journal leg and cone are formed may be used. Phosphorous bronze, copper lead, carburized steel and the like may also be suitable for this purpose.

To assemble all of the aforementioned bearing and retaining components and lock the cone 12 in place on the journal leg 22, the radial thrust bearing 48 is placed on the bearing surface 42 of the journal leg. The pin 54 is inserted into the cone receptacle 46 so that the cone engaging surface 74 contacts cone stop 76. Cone retainer and bearing 82 is inserted into cone receptacle 46, compressed to fit past ledge 84 and then released to snap into place in cone groove 47 as shown in FIG. 3. To hold the cone in place effectively, the cone retainer 82 must contact both the pin shoulder retention surface 72 and a cone shoulder 86 formed by the annular groove 47. When the cone 12 is properly secured to the pin by retainer and bearing 82, pin retainer 80 is placed in the groove 62 on pin 54. The pin and cone subassembly is then press fitted into journal leg central bore 36 so that the lower surface 68 of pin stop 66 contacts the surface 38 of the journal 22. Retainer 80 will be kept in a compressed condition during assembly until pin groove 62 is aligned with journal groove 44, whereupon the retainer 80 will expand into groove 44, as shown in FIG. 3. The interior and exterior dimensions of retainer 80 must be selected to allow retainer 80 to engage both pin lip 64 and edge 88 of the journal groove 44.

A sealing element 90, which is preferably in the form of an O-ring type of seal, is provided where the cone 12 contacts the journal to prevent the leaking of lubricant from cone receptacle 46, and the subsequent diversion of lubricant from the bearing structures.

The arrangement described above locks the cone 12 on the pin 54 and locks the pin 54 in the journal leg 22 and provides both the capability for absorbing axial thrust in both directions along the longitudinal axis of the journal leg 22 and the capability for absorbing radial thrust. Moreover, the bearing and retaining structure shown and described herein creates a thrust load carrying capability in the normally loaded axial direction and radially which is superior to that of prior art structures.

Industrial Applicability

The thrust bearing and cone locking arrangement of the present invention will find its primary applicability in securing the cutter cones to the body of a rock drill bit of the type used to drill earth formations during oil and gas exploration. However, the present bearing and cone locking arrangement could also be employed to rotatably lock any rotating element subjected to thrust loading to a supporting journal so that the rotating element is securely locked to the journal even when subjected to axial thrust loads in opposite directions.

I claim:

1. A thrust bearing and cone locking assembly for rotatably mounting a cutter cone on the body of a rock drill bit having at least one leg section depending from said bit body and a journal leg attached thereto to support said cone so that the axis of said cone is oriented toward the center of the bit body, said assembly comprising:

a. axial thrust bearing means for absorbing axial forces directed to said cone in opposite directions parallel to the longitudinal axis of said cone;

b. radial thrust bearing means extending along substantially the entire axial extent of said journal leg for rotatably mounting said cone on said journal leg to absorb radial forces perpendicular to the longitudinal axis of said cone;

c. radially compressible journal leg retaining means for locking said axial thrust bearing means to said journal leg, and d. radially compressible combined cone retaining and thrust bearing means for locking said axial thrust bearing means to said cone and providing expanded axial thrust bearing capability to said assembly.

2. The thrust bearing and cone locking assembly described in claim 1, wherein said journal leg includes a central longitudinal channel, said axial thrust bearing means comprises a unitary profiled longitudinal pin, and one end of said pin is disposed within said channel.

3. The thrust bearing and cone locking assembly described in claim 2, wherein said cone includes a central receptacle and the other end of said pin is disposed within said receptacle.

4. The thrust bearing and cone locking assembly described in claim 3, wherein said radial thrust bearing means is positioned within said cone receptacle so that said radial thrust bearing means contacts said cone and said journal leg.

5. The thrust bearing and cone locking assembly described in claim 4, wherein said journal leg retaining means and said combined cone retaining and thrust bearing means are positioned at spaced locations along the length of said pin, and said journal leg retaining means is disposed radially of said pin to contact said pin and said journal central channel, and said combined cone retaining and thrust bearing means is disposed radially of said pin to contact said pin and said cone receptacle.

6. The thrust bearing and cone locking assembly described in claim 5, wherein said journal leg retaining means comprises a substantially circular snap ring having a substantially circular cross-section and said combined cone retaining and thrust bearing means comprises a substantially circular snap ring having a substantially rectangular cross-section.

7. The thrust bearing and cone locking assembly described in claim 6, wherein said bearing means are formed of beryllium copper alloy.

8. The thrust bearing and cone locking assembly described in claim 7, wherein said pin profile includes stop means to limit the axial penetration of said pin into said journal leg central channel and said pin further includes shoulder means to limit the axial penetration of said pin into said cone receptacle.

9. The thrust bearing and cone locking assembly described in claim 8, wherein said journal leg includes lubricant supply means in fluid communication with the bit body for directing lubricant to said bearing means.

10. The thrust bearing and cone locking assembly described in claim 9, wherein said lubricant supply means includes conduit means extending between said journal leg central channel and said radial thrust bearing means for directing lubricant to said bearing means.

11. The thrust bearing and cone locking assembly described in claim 10, wherein said pin includes channel means in fluid communication with said lubricant supply means and said cone central receptacle for directing lubricant to said thrust bearing means.

12. The thrust bearing and cone locking assembly described in claim 11, further including seal means disposed between said journal leg and said cone central receptacle for preventing leakage of lubricant from said cone central receptacle during drill operation.

13. The thrust bearing and cone locking assembly described in claim 2, wherein said unitary profiled longitudinal pin includes a champfered journal engaging end, an opposite planar cone engaging end, and a central body section, wherein said central body section is separated from said journal engaging end by an annular groove and said central body section is separated from said cone engaging end by an annular shoulder and an annular stop stepped inwardly from and having a smaller diameter than said shoulder.

14. The thrust bearing and cone locking assembly described in claim 13, wherein said central body section has a diameter slightly larger than said journal engaging end and substantially the same as said

15. The thrust bearing and cone locking assembly described in claim 14, wherein said pin further includes a central longitudinal interior channel extending from said journal engaging end to said cone engaging end to provide fluid communication therebetween.

16. A rotary rock drill bit comprising:

a. a main bit body having at least one leg section extending therefrom;

b. at least one cutter cone rotatably mounted to said leg section;

c. journal means for mounting said cutter cone on said leg section, said journal means including a central longitudinal channel having an annular groove therein;

d. radial thrust bearing means extending along substantially the entire length of said journal means located circumferentially of said journal means for rotatably mounting said cone on said journal means and absorbing radial thrust during drill operation;

e. combined connector and thrust bearing means for securing said cone to said journal means and absorbing both axial and radial thrust during drill operation, wherein said combined connector and thrust bearing means comprises a unitary longitudinal pin having a journal means engaging end and an opposite cone engaging end, and said pin includes an annular groove located toward said journal means engaging end, an annular shoulder located toward said cone engaging end, and stop means for engaging said journal means;

f. journal means retaining means for retaining said combined connector and thrust bearing means in said journal means; and g. cone retaining means for retaining said cone on said combined connector and thrust bearing means, said cone retaining means having a crosssectional configuration that is different from the cross-sectional configuration of said journal means retaining means.

17. The rock drill bit described in claim 16, wherein said journal means retaining means and said cone retaining means are radially compressible.

18. The rock drill bit described in claim 17, wherein said journal means retaining means comprises a substantially circular snap ring and has a substantially circular cross-sectional configuration.

19. The rock drill bit described in claim 18, wherein said cone retaining means comprises a substantially circular snap ring and has a substantially rectangular cross-sectional configuration.

20. The rock drill bit described in claim 19, wherein said journal means engaging means is received in said pin annular groove and said cone engaging means contacts said pin annular shoulder when said connector and thrust bearing means secures said cone to said journal means.

21. The rock drill bit described in claim 20, wherein said cutter cone includes receptacle means for receiving said journal means, said radial thrust bearing means, said longitudinal pin and said cone engaging means, and said cone receptacle means includes stop means for limiting the axial penetration of said pin into said receptacle means and ledge means located relative to said stop means to form an annular groove therebetween.

22. The rock drill bit described in claim 21, wherein said journal means engaging end of said longitudinal pin is positioned in said journal means central longitudinal channel so that said pin annular groove aligns with said channel annular groove and said journal means retaining means is disposed within both of said grooves to contact said pin and said journal means, and said cone engaging end is positioned in said cone receptacle means so that said pin annular shoulder contacts said stop means and said cone retaining means is disposed within the annular groove between said stop means and said ledge means to contact said pin and said cone.

23. The rock drill bit described in claim 22, wherein said pin is formed from a beryllium copper alloy.

* * * * *